US008884732B2

(12) United States Patent
Johnson et al.

(10) Patent No.: US 8,884,732 B2
(45) Date of Patent: Nov. 11, 2014

(54) DRY-TYPE NETWORK TRANSFORMER

(75) Inventors: Charles W. Johnson, Wytheville, VA (US); Samuel S. Outten, Wytheville, VA (US)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 13/399,165

(22) Filed: Feb. 17, 2012

(65) Prior Publication Data

US 2012/0212312 A1 Aug. 23, 2012

Related U.S. Application Data

(60) Provisional application No. 61/445,095, filed on Feb. 22, 2011.

(51) Int. Cl.

| | |
|---|---|
| ***H01F 27/08*** | (2006.01) |
| ***H01F 27/02*** | (2006.01) |
| ***A62C 3/16*** | (2006.01) |
| ***A62C 99/00*** | (2010.01) |

(52) U.S. Cl.

CPC *H01F 27/02* (2013.01); *A62C 3/16* (2013.01); *A62C 99/0018* (2013.01)

USPC ..... 336/55; 336/57; 336/90

(58) Field of Classification Search

CPC ..... H01F 27/02; H01F 27/08; H01F 27/18; H01F 27/085; H01F 27/321

USPC ..... 336/55, 58, 90, 94, 57, 60, 179; 361/62, 361/620, 623

See application file for complete search history.

(56) References Cited

U.S. PATENT DOCUMENTS 2,024,742 A * 12/1935 Parsons ..... 361/268
2,397,099 A * 3/1946 Gates et al. ..... 361/38

(Continued)

FOREIGN PATENT DOCUMENTS

CA 2713566 A1 2/2011
CN 2517085 Y 10/2002

(Continued)

OTHER PUBLICATIONS

Network Transformers, Catalog Section 94-10; Network Transformers, Apr. 9, 2010, pp. 1-7, XP055056756. Retrieved from the Internet: URL:http://www.howard-ind.com/howardtransformers/Literature/NetworkTransformer.pdf (retrieved on Mar. 15, 2013) pp. 1-3,5.

(Continued)

*Primary Examiner* — Elvin G Enad
*Assistant Examiner* — Joselito Baisa
(74) *Attorney, Agent, or Firm* — Melissa J. Szczepanik

(57) ABSTRACT

A dry-type network transformer has a core and coil windings insulated by a combustion-inhibiting gas. The combustion-inhibiting gas, core and coil windings are disposed within a hermetically-sealed enclosure. The combustion-inhibiting gas is air, an inert gas or a mixture of gases. The dry-type network transformer may be connected to a network protector. The network protector is further connected to a secondary network. The network protector prevents power from flowing from a secondary network to the primary side of the transformer. The dry-type network transformer is installed in a vault that is underground or at ground level. The dry-type network transformer may be suspended near the ceiling of the vault or installed at the base of the vault.

16 Claims, 2 Drawing Sheets

(56) References Cited

U.S. PATENT DOCUMENTS

| | | | | | |
|---|---|---|---|---|---|
| 2,872,651 | A | * | 2/1959 | Treanor | 336/58 |
| 3,240,848 | A | * | 3/1966 | Burke et al. | 264/102 |
| 3,466,017 | A | * | 9/1969 | Malvin | 366/117 |
| 3,602,631 | A | * | 8/1971 | Sheppard | 174/17 R |
| 3,762,939 | A | | 10/1973 | Hunter | |
| 3,953,815 | A | * | 4/1976 | Raupach | 336/90 |
| 4,055,825 | A | * | 10/1977 | Kleen et al. | 336/70 |
| 4,117,525 | A | * | 9/1978 | Moore | 361/37 |
| 4,160,178 | A | * | 7/1979 | Smith et al. | 310/43 |
| 4,485,367 | A | * | 11/1984 | Hashizume | 336/57 |
| 5,736,915 | A | | 4/1998 | Goedde | |
| 5,844,781 | A | * | 12/1998 | Schlotterer et al. | 361/752 |
| 6,160,464 | A | | 12/2000 | Clarke | |
| 6,859,124 | B2 | | 2/2005 | Nishimizu | |
| 7,755,868 | B2 | | 7/2010 | Flores Losada | |
| 8,068,320 | B2 | | 11/2011 | Faulkner et al. | |
| 8,085,122 | B2 | | 12/2011 | Niess | |
| 2003/0080841 | A1 | | 5/2003 | Nishimizu | |
| 2010/0142108 | A1 | | 6/2010 | Faulkner | |

FOREIGN PATENT DOCUMENTS

| | | | |
|---|---|---|---|
| CN | 2906861 | Y | 5/2007 |
| CN | 200953264 | Y | 9/2007 |
| CN | 201315216 | Y | 9/2009 |
| CN | 201392711 | Y | 1/2010 |
| CN | 201465737 | U | 5/2010 |
| CN | 201749766 | U | 2/2011 |
| JP | H1131623 | A | 2/1999 |

OTHER PUBLICATIONS

Kaveckaite, Ausra, European Patent Office, Partial International Search Report for corresponding International Application No. PCT/US2012/025808, pp. 1-3, having a mail date of Mar. 26, 2013.

W. Weisser, International Searching Authority (EPO), International Search Report and Written Opinion of the International Searching Authority for International Application No. PCT/US2012/025808, European Patent Office, mailed Jun. 6, 2013.

"Secondary Network Transformers," Bulletin #SNT 299, R.E. Uptegraff Manufacturing Company, pp. 1-6, Sep. 20, 2007, retrieved from the internet: URL:http://web.archive.org/web/20070920111212/http://www.uptegraff.com/pdf/publications/24.pdf.

"IEEE Standard Requirements for Secondary Network Transformers, Subway and Vault Types (Liquid Immersed)," IEEE Standard C57.12.40/2006 (Revision of ANSI C57.12.40-2000, pp. 1-19, Jan. 1, 2006.

* cited by examiner

DRY-TYPE NETWORK TRANSFORMER

CROSS REFERENCE TO RELATED APPLICATION

This application claims the benefit of U.S. provisional patent application No. 61/445,095 filed on Feb. 22, 2011, which is hereby incorporated by reference in its entirety.

FIELD OF INVENTION

The present application is directed to a dry-type network transformer having a core, one or more coil assemblies, and a combustion-inhibiting gas disposed within a hermetically-sealed enclosure.

BACKGROUND

Network transformers are used to deliver power to metropolitan areas and are typically housed in vaults located underground or at surface level. Network transformers receive power from a primary network which is the power source and deliver power through a secondary network to consumers. Network transformers are typically fluid-filled, utilizing a dielectric fluid to insulate the core and coil windings. When a fluid-filled network transformer ruptures due to a fault or other failure, the fluid may spread into heavily populated areas and pollute the environment. Accordingly, there is a need for a new type of network transformer that is insulated with a non-toxic material and stable against rupture. The present invention is directed to such a network transformer having a benign and non-volatile insulating medium.

SUMMARY

A dry-type network transformer receives power from a primary power source at one voltage, converts the power, and provides electricity at a second voltage to a secondary network. The dry-type network transformer has a ferromagnetic core with one or more limbs connected to top and bottom yokes. The core limbs are vertically-located between the horizontal top yoke and the horizontal bottom yoke. A coil assembly is mounted to each core limb.

The dry-type network transformer has a hermetically-sealed enclosure made up of one or more side walls, a bottom wall, and a lid. The hermetically-sealed enclosure is used to house the ferromagnetic core, coil assemblies and a combustion-inhibiting gas. The core and coil assemblies are located inside the hermetically-sealed enclosure along with the combustion-inhibiting gas. The combustion-inhibiting gas surrounds the core and coil assemblies.

The hermetically-sealed enclosure has a connective throat extending from a wall. The connective throat encloses electrical connections at the output terminal of the transformer. A network protector is attached at the connective throat of the transformer. The network protector protects the network transformer from receiving power flow in a direction from the secondary network to the primary side of the transformer.

The dry-type network transformer is constructed using a ferromagnetic core, coil assemblies, and a hermetically-sealed enclosure. The core and coil assemblies are assembled and placed into the hermetically-sealed enclosure. The enclosure is sealed with a lid having one or more inlets. A combustion-inhibiting gas is introduced through an inlet into an internal space within the enclosure. The combustion-inhibiting gas surrounds the core and coil assemblies of the dry-type network transformer.

BRIEF DESCRIPTION OF THE DRAWINGS

In the accompanying drawings, structural embodiments are illustrated that, together with the detailed description provided below, describe exemplary embodiments of a dry-type network transformer. One of ordinary skill in the art will appreciate that a component may be designed as multiple components or that multiple components may be designed as a single component.

Further, in the accompanying drawings and description that follow, like parts are indicated throughout the drawings and written description with the same reference numerals, respectively. The figures are not drawn to scale and the proportions of certain parts have been exaggerated for convenience of illustration.

DETAILED DESCRIPTION

Figure 1:
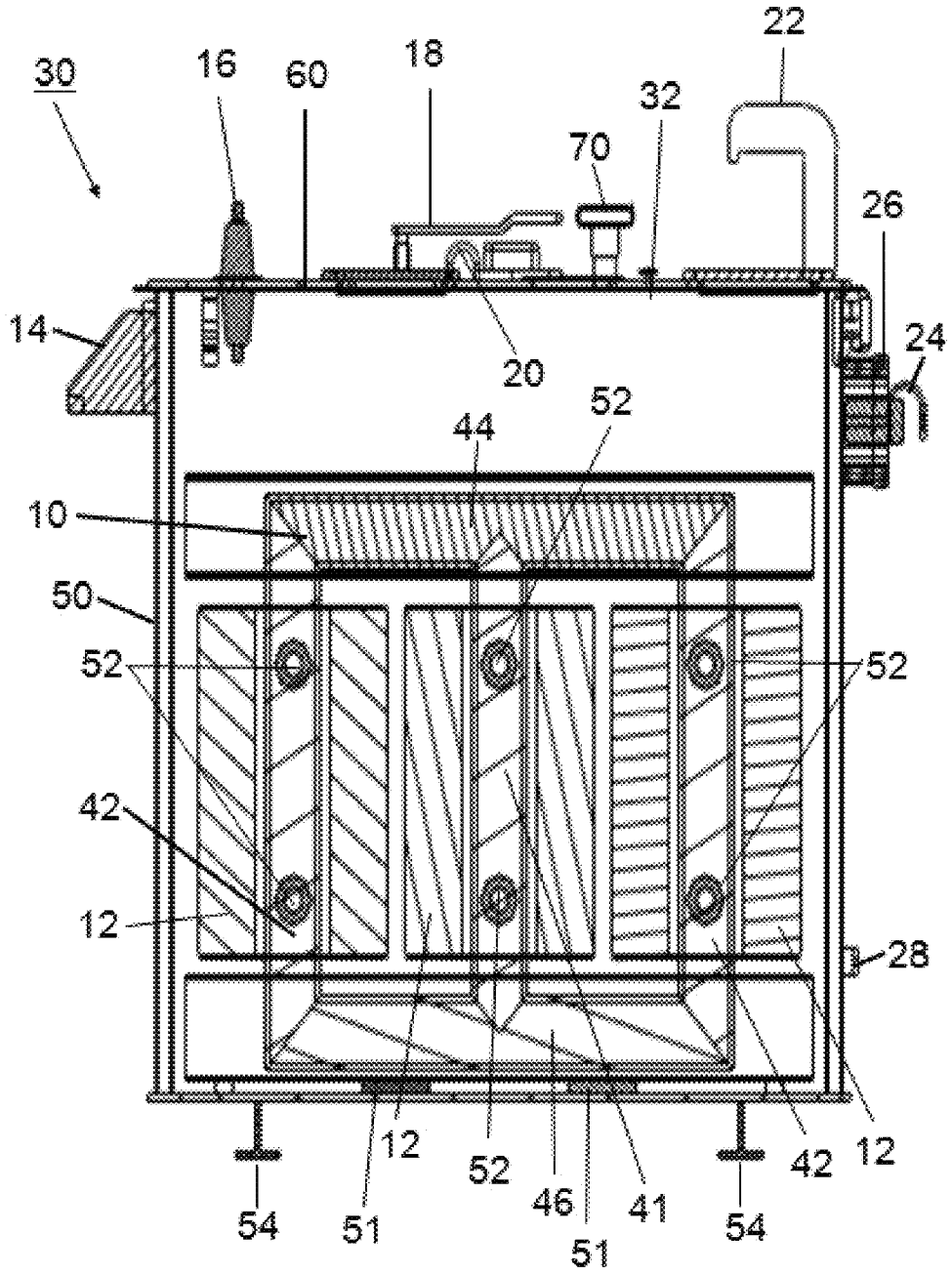
FIG. 1 is sectional front view of a dry-type network transformer.

Referring to FIG. 1, the dry-type network transformer 30 of the present invention is shown. The dry-type network transformer 30 may be single phase or poly-phase (e.g. three phases). The dry-type network transformer 30 may be comprised of a core-type or shell-type construction. The core 10 of the dry-type network transformer 30 is comprised of thin, stacked laminations of magnetically permeable material such as grain-oriented silicon steel or amorphous metal. The laminations are typically arranged in stacks such that the core 10 has one or more legs or limbs 42 disposed vertically between a pair of top and bottom yokes 44, 46 disposed horizontally. The laminations may be held together by core clamps, wherein a top core clamp compresses the top yoke 44 of the core and a bottom core clamp compresses the bottom yoke 46 of the core 10.

A coil assembly 12 is disposed around each core limb 41, 42 in a core-type transformer. In a shell-type transformer, a coil assembly 12 is disposed around the inner core limb 41. Each coil assembly 12 comprises high-voltage primary and low-voltage secondary coil windings. The high-voltage primary and low-voltage secondary coil windings are often arranged concentrically around each core limb 41, 42. Other arrangements include the mounting of high-voltage primary and low-voltage secondary windings one above the other around each core limb 41, 42 or an interleaved arrangement having alternating high-voltage primary and low-voltage secondary windings mounted to the inner core limb 41. The high-voltage primary and low-voltage secondary coil windings of the present invention are comprised of a conductive material such as copper or aluminum. The high-voltage primary and low-voltage secondary windings may be vacuum-cast or resin-encapsulated.

The high-voltage primary and low-voltage secondary coil windings may be wound in an elliptical shape around each core limb 41, 42. The high-voltage primary and low-voltage secondary coil windings occupy less space within an enclosure 50 when elliptically-wound, thus providing the dry-type network transformer 30 with a more compact design.

The core 10 and coil assemblies 12 of the dry-type network transformer 30 are disposed inside a hermetically-sealed enclosure 50, the enclosure 50 comprising one or more side walls, a bottom wall and a lid 60. The enclosure 50 may be cylindrical, in which case there is a single cylindrical side wall, or generally rectangular, in which case there are four side walls. The bottom core clamp of the transformer 30 has mounting feet 51 containing openings that are adapted to engage with circular pins extending from the bottom wall of the enclosure 50, thereby anchoring the transformer to the interior of the hermetically-sealed enclosure 50. The top core clamp of the transformer 30 has opposing ends, wherein each one of the opposing ends are bolted or pinned to an inside side wall of the hermetically-sealed enclosure 50. The hermetically-sealed 50 enclosure is then sealed by the lid 60.

The lid 60 and a top edge 77 of the enclosure 50 form a barrier, sealing the enclosure 50. The top edge 77 is embodied as a lip that extends outward from the surface of the enclosure. Alternatively, the top edge 77 may be radiused inward wherein outside edges of the lid 60 interface with the curvature of the top edge 77, depending on the application. The top edge 77 may be radiused along the entire interface between the enclosure 50 and the lid 60.

In an embodiment having the top edge 77 radiused inward, the curvature of the top edge 77 is formed from the transition of a vertical portion of the top edge 77 to a horizontal portion of the top edge 77. In that same embodiment, the outside edges of the lid 60 may be curved and seated within the curvature of the top edge 77 of the enclosure 50.

A vacuum pump may be connected to one of a plurality of fittings 32 located in the lid 60 of the enclosure 50 to draw an airtight seal within the enclosure 50. A combustion-inhibiting gas is introduced inside the hermetically-sealed enclosure 50 through one of the plurality of fittings 32 located in the lid 60 of the hermetically-sealed enclosure 50. The combustion-inhibiting gas fills an internal space within the hermetically-sealed enclosure 50 and surrounds the core 10 and coil assemblies 12. The combustion-inhibiting gas may be air, an inert gas such as nitrogen, argon, xenon, et al., or a mixture of the aforementioned gases.

In designing the hermetically-sealed enclosure 50, the thermal properties of the combustion-inhibiting gas are considered along with the dimensions of the hermetically-sealed enclosure 50, and energy losses experienced by the transformer core 10 and coil assemblies 12. An example of the parameters utilized when nitrogen is employed as the combustion-inhibiting gas in a dry-type network transformer follows. Nitrogen has a thermal conductivity equal to 0.026 W/M° C., the tank dimensions are approximately 5.5 feet by 3.5 feet by 5 feet, and the pressure is maintained in the range of 0.25 atmosphere to 1 atmosphere. The combination of the aforementioned parameters typically prevents the operating temperature of the transformer from exceeding 220 degrees Celsius. The efficiency of a 500 kVA transformer having a primary voltage of 13 kV and a Wye-secondary voltage of 216 V operating under the aforementioned parameters is typically greater than or equal to 99%.

In addition to serving as an entry point for the combustion-inhibiting gas, the fittings 32 may also be used to pressurize the hermetically-sealed enclosure 50, evacuate the hermetically-sealed enclosure 50, or connect a pressure gauge. Additional pressure and temperature gauges 70 may be located on the lid of the hermetically-sealed enclosure 50. In one embodiment of the present invention, the combustion-inhibiting gas is pressurized up to 1 atmosphere. A pressure relief valve is provided to decrease the pressure in the hermetically-sealed enclosure 50. Since the combustion-inhibiting gas is maintained at a low pressure and is non-volatile, the dry-type network transformer 30 operates in a stable manner. Prior to filling the hermetically-sealed enclosure 50 with an inert gas, the hermetically-sealed enclosure 50 should be evacuated to remove as much oxygen as possible.

A primary power source connects to the high-voltage primary bushings 16 of the dry-type network transformer 30. The high-voltage primary bushings 16 are connected to high-voltage leads 52 extending from the high-voltage primary coil windings. The high-voltage leads 52 may be connected together in a Delta or a Wye configuration.

The low-voltage secondary coil windings have low-voltage leads that extend from the coils and may be connected together in a Delta or a Wye configuration. The low voltage leads are connected to a bus bar. In turn, the bus bar is connected to low-voltage terminations 24 which are rods of approximately one inch in diameter that originate inside the hermetically-sealed enclosure 50 and extend through the low-voltage throat 26 of the hermetically-sealed enclosure 50. The low-voltage throat 26 serves to connect a network protector 40 to the dry-type network transformer 30. The low-voltage throat 26 also houses the electrical connections between the low-voltage terminations 24 and the input of the network protector 40, which is to be described in more detail below.

Figure 2A:
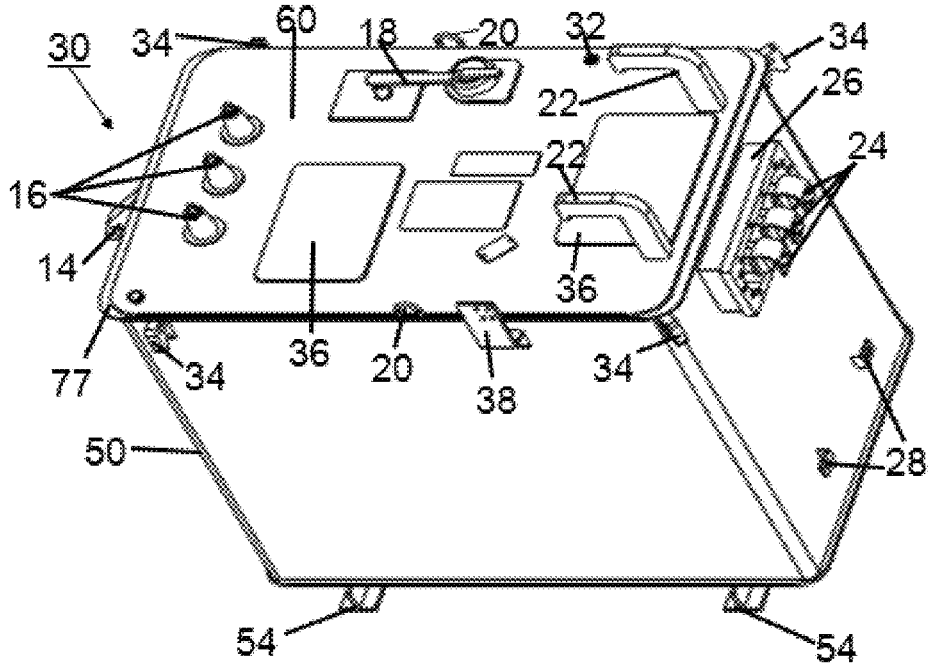
FIG. 2*a* is a perspective view of a dry-type network transformer.
Figure 2B:
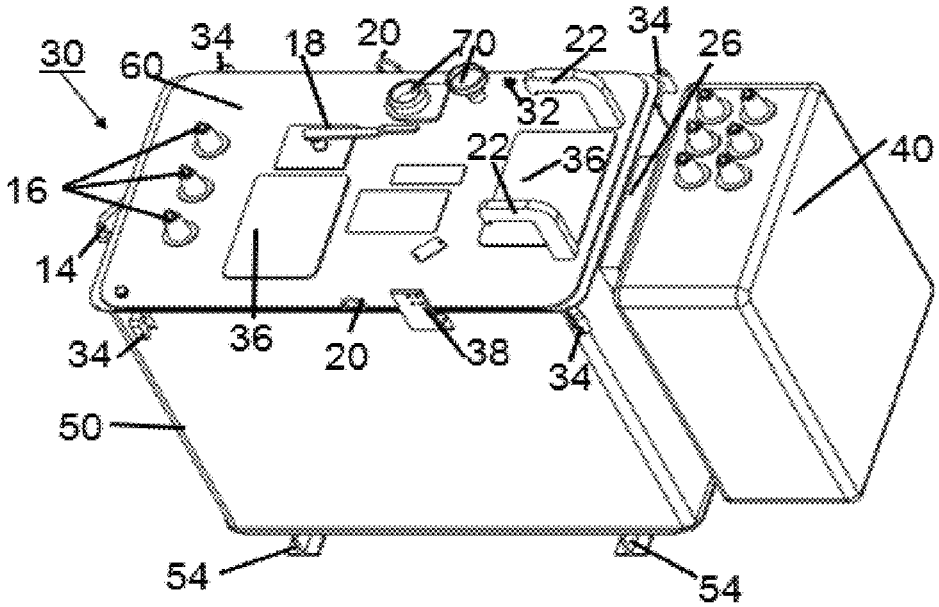
FIG. 2*b* is a perspective view of a dry-type network transformer shown connected to a network protector.

Referring now to FIGS. 2*a* and 2*b*, the low-voltage terminations 24 of the dry-type network transformer 30 are shown connected to a network protector 40. The network protector 40 is removeably mounted to the low-voltage throat 26 and support brackets 28 of the dry-type network transformer 30. The transformer throat 26 extends from a side wall of the hermetically-sealed enclosure 50 and supports the weight of the network protector 40. The support brackets 28 are attached to a side wall of the hermetically-sealed enclosure 50 and are used for holding the network protector 40 in an upright position.

A network protector 40, that is acceptable for use in the present invention, is available as Model No. 137NP-3000-LTS from the Richards Manufacturing Company of Irvington, N.J., although many other network protectors 40 including network protectors 40 made by other manufacturers are acceptable. The network protector 40 is comprised of a relay switch, an input, an output, and a circuit breaker located between the input and output. The circuit breaker is electrically connected to the output of the network protector 40. The network protector input is connected to the output of the transformer 30 at the transformer throat 24 and is electrically connected to the low voltage terminations 24.

The network protector 40 connects and disconnects the network transformer 30 to and from a secondary network. The network protector 40 connects the network transformer 30 to the secondary network when power is flowing in a direction from the primary side to the secondary side of the network transformer 30. When the power is flowing in the opposite direction, from the secondary side to the primary side, the network protector 40 relay switch trips open the circuit breaker upon detection of power flow in the opposite direction. The circuit remains open until the system is safe for reconnection.

The dry-type network transformer 30 is housed in a vault that is located underground or at surface level. When the vault is located underground, it is typically ventilated through an opening near the ceiling of the vault or grates in the concrete of a city sidewalk. The network transformer 30 may be suspended near the ceiling of the vault or installed at the bottom of the vault. The lid 60 of the network transformer 30 has two suspension support hooks 22 and a toe 14 for mounting the transformer 30 near the ceiling of the vault, as shown in FIGS. 2*a* and 2*b*. The suspension support hooks 22 are mounted on beams near the ceiling of the vault and the toe 14 is mounted to an inside side wall of the vault. The toe 14 has a keyhole-shaped opening for receiving the end of a keyhole-shaped, rigidly-mounted bracket attached to an inside side wall of the vault. When the transformer 30 is suspended, it allows for easier access to the network protector 40 and access panels 36 for maintenance. Suspension of the transformer 30 may also reduce the noise level of the transformer 30, due to the isolation of the transformer 30 from a contact surface. The network transformer 30 is provided with lifting hooks 34 for raising the hermetically-sealed enclosure 50 to the desired level in the vault. The lid 60 of the transformer 30 also has lifting points 20 for use during installation.

Instead of being suspended, the network transformer 30 may be installed at the bottom of the vault on feet 54 that are attached to the base of the hermetically-sealed enclosure 50. The feet 54 keep the base of the transformer 30 from touching the floor of the vault. The clearance between the vault floor and the transformer 30 renders the transformer 30 accessible to lifting equipment such as a fork lift truck.

A high-voltage grounding switch 18 is included in one embodiment of the network transformer 30. When the high-voltage grounding switch 18 is present, it is connected to the high-voltage primary bushings 16 and may be mounted to the interior or exterior of the hermetically-sealed enclosure 50. The grounding switch 18 connects the high-voltage primary bushings 16 to ground, whereby the grounding source may be a wall of the hermetically-sealed enclosure 50. The grounding switch 18 is manually operated and is used to ground the network transformer 30 when maintenance is being performed.

A neutral bar 38 is provided on the low-voltage side of the transformer 30 and connects to the secondary low-voltage coil windings. A neutral connection extends from the hermetically-sealed enclosure 50 and connects to the neutral bar 38. The neutral bar 38 provides a neutral connection between the low-voltage primary coil windings.

The dry-type network transformer 30 of the present invention may be located underground, where it is exposed to groundwater. In such an embodiment, the transformer 30 is sealed and protected, through the application of a sealant to the hermetically-sealed enclosure 50. The sealant may be a polymer coating that inhibits corrosion and is impermeable to water.

In one embodiment, the transformer 30 is a 1,000 kVA dry-type network transformer 30. However, it should be understood that the capacity and/or rating of the dry-type network transformer 30 may vary depending on the application.

While the present application illustrates various embodiments of a dry-type network transformer, and while these embodiments have been described in some detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative embodiments, and illustrative examples shown and described. Accordingly, departures may be made from such details without departing from the spirit or scope of the applicant's general inventive concept.

What is claimed is:

1. A network transformer for providing power to a secondary network comprising:

a ferromagnetic core comprising at least one limb extending between the first and second yokes;

at least one coil assembly comprising a high-voltage primary winding disposed around a low-voltage secondary winding mounted to said at least one limb and wherein each said high-voltage and low-voltage winding is wound in an elliptical shape around said at least one limb;

a hermetically-sealed enclosure encapsulated by a polymer sealant, said hermetically-sealed enclosure having an interior space within which said ferromagnetic core and said coil assembly are disposed, said hermetically-sealed enclosure having a connective throat extending from a wall of said hermetically-sealed enclosure to enclose electrical connections between low-voltage terminations and an input of a network protector;

a combustion-inhibiting gas disposed within said interior space of said hermetically-sealed enclosure, said combustion-inhibiting gas surrounding said ferromagnetic core and said at least one coil assembly and wherein said combustion-inhibiting gas is maintained at a pressure in the range of 0.25 atmosphere to 1 atmosphere and at a temperature in order to prevent the operating temperature of the transformer from exceeding 220 degrees Celsius; and said network protector removeably mounted to said connective throat of said hermetically-sealed enclosure, said network protector being operable to protect said network transformer from power flowing from said secondary network.

2. The network transformer of claim 1 wherein said combustion-inhibiting gas is an inert gas.

3. The network transformer of claim 1 wherein said network protector is comprised of a relay switch for opening and closing a network protector circuit, an input terminal, an output terminal, a circuit breaker disposed between said input terminal and said output terminal, said circuit breaker electrically connected to said output terminal.

4. The network transformer of claim 3 wherein said network protector is removeably mounted to a plurality of support brackets and said connective throat of said hermetically-sealed enclosure, said support brackets rigidly attached to the wall of said hermetically-sealed enclosure.

5. The network transformer of claim 4 wherein said network protector input terminal is electrically connected to a secondary output terminal, said secondary output terminal extending from said connective throat of said hermetically-sealed enclosure.

6. The network transformer of claim 1 wherein each said high-voltage primary winding and each said low-voltage secondary winding are vacuum-cast.

7. The network transformer of claim 1 wherein each said high-voltage primary winding and each said low-voltage secondary winding are configured in an elliptical shape around the at least one limb.

8. The network transformer of claim 1 wherein said hermetically-sealed enclosure comprises: at least two hooks disposed proximate to and extending from a side edge of a top lid of said hermetically-sealed enclosure, the at least two hooks being adapted to engage with a beam proximate to a ceiling of a vault; and a bracket having a key-hole shaped opening rigidly attached to and extending from a side wall of said hermetically-sealed enclosure, said bracket being adapted to engage with a key-hole shaped tab rigidly attached to an inside side wall of said vault.

9. The network transformer of claim 8 wherein said hermetically-sealed enclosure further comprises an access panel disposed on said top lid of said hermetically-sealed enclosure for accessing said interior space of said hermetically-sealed enclosure for maintenance.

10. The network transformer of claim 1 further comprising a grounding switch mounted to said hermetically-sealed enclosure and being operable to connect said each high-voltage primary coil winding to ground.

11. The network transformer of claim 1 further comprising a neutral bar disposed on a wall of said hermetically-sealed enclosure, said neutral bar connecting each low-voltage secondary coil winding to a neutral connection.

12. The transformer of claim 1 wherein the combustion-inhibiting gas is nitrogen.

13. The transformer of claim 1 wherein the combustion-inhibiting gas is air.

14. The transformer of claim 1 wherein the combustion-inhibiting gas is a member selected from a group consisting of nitrogen, argon, xenon, and a mixture of the aforementioned gases.

15. A method of forming a network transformer, comprising: a. providing a ferromagnetic core comprising at least one limb extending between first and second yokes; b. mounting at least one coil assembly to the at least one limb; c. providing a hermetically-sealed enclosure, said hermetically-sealed enclosure having a passage through which a gas may travel between an interior space within said hermetically-sealed enclosure and an environment outside said hermetically-sealed enclosure; d. placing said ferromagnetic core and said at least one coil assembly into said interior space of said hermetically-sealed enclosure; e. sealing said hermetically-sealed enclosure with a lid to fully enclose said ferromagnetic core and said at least one coil assembly; f. introducing a combustion-inhibiting gas into said interior space of said hermetically-sealed enclosure through said passage, said combustion-inhibiting gas surrounding said ferromagnetic core and said at least one coil assembly; and g. maintaining said combustion-inhibiting gas at a pressure in the range of 0.25 atmosphere to 1 atmosphere and at a temperature in order to prevent the operating temperature of the transformer from exceeding 220 degrees Celsius.

16. The transformer of claim 15 wherein the combustion-inhibiting gas is nitrogen.

* * * * *